US012722062B2

(12) United States Patent
Peterich, II

(10) Patent No.: US 12,722,062 B2
(45) Date of Patent: Sep. 1, 2026

(54) GOLF PUTTING TRAINING DEVICE

(71) Applicant: Scott Lawrence Peterich, II, Lakeland, FL (US)

(72) Inventor: Scott Lawrence Peterich, II, Lakeland, FL (US)

( * ) Notice: Subject to any disclaimer, the term of this patent is extended or adjusted under 35 U.S.C. 154(b) by 0 days.

(21) Appl. No.: 17/527,986

(22) Filed: Nov. 16, 2021

(65) Prior Publication Data

US 2023/0149788 A1 May 18, 2023

(51) Int. Cl.
*A63B 69/36* (2006.01)

(52) U.S. Cl.
CPC ..... *A63B 69/3621* (2020.08); *A63B 69/3676* (2013.01)

(58) Field of Classification Search
CPC ..... A63B 69/3621; A63B 69/3676
USPC ..... 473/252, 257, 258, 261, 262, 264, 265, 473/266, 273
See application file for complete search history.

(56) References Cited

U.S. PATENT DOCUMENTS

| | | | | | |
|---|---|---|---|---|---|
| 2,992,005 | A * | 7/1961 | Lockhart | A63B 69/3676 | 473/218 |
| 4,913,440 | A * | 4/1990 | Ellington | A63B 69/3623 | 473/265 |
| 6,840,870 | B1 * | 1/2005 | Froggatte | A63B 24/0003 | 473/265 |
| D641,448 | S * | 7/2011 | Sessions | D21/791 | |
| D692,512 | S * | 10/2013 | Fanfelle | D21/791 | |
| D717,898 | S * | 11/2014 | Pfaff | D21/791 | |
| 10,695,642 | B1 * | 6/2020 | Robinson | A63B 69/3661 | |
| 2009/0227388 | A1 * | 9/2009 | Schmutz | A63B 69/3661 | 473/409 |
| 2010/0035699 | A1 * | 2/2010 | Sorenson | A63B 69/3621 | 473/278 |
| 2014/0335969 | A1 * | 11/2014 | Ellington | A63B 69/3621 | 473/409 |

* cited by examiner

*Primary Examiner* — Nini F Legesse
(74) *Attorney, Agent, or Firm* — Distinct Patent Law; Justin P. Miller

(57) ABSTRACT

A golf putting training device includes a body having a first elongate portion and a second elongate portion joined by a center portion having an arcuate recess configured to receive a golf ball. The first and second elongate portions form a channel extending from the arcuate recess at a proximate end to an opening at a distal end. Two guide pins are selectively positionable in paired guide apertures that converge from the proximate end toward the distal end to define multiple putting difficulty levels based on separation distance between the guide pins.

13 Claims, 10 Drawing Sheets

GOLF PUTTING TRAINING DEVICE

FIELD

Some implementations relate generally to golf training devices, and, more particularly, to a golf putting training device.

BACKGROUND

Some conventional golf putting training devices or aids can include matts that may be cumbersome to use and store. Other conventional putting training aids may use electronics and lasers and may be expensive and/or complicated to use. Still other training aids may have a physical guide for the putter that is relatively short in length and may be limited in training for the golf putting swing.

Embodiments were conceived in light of the above-mentioned needs, problems and limitations, among other things. The background description provided herein is for the purpose of generally presenting the context of the disclosure. Work of the presently named inventor, to the extent it is described in this background section, as well as aspects of the description that may not otherwise qualify as prior art at the time of filing, are neither expressly nor impliedly admitted as prior art against the present disclosure.

SUMMARY

Some implementations can include a putting training device comprising a body having a first elongate portion and a second elongate portion that are joined by a center portion having an arcuate recess at a proximate end of the first elongate portion and the second elongate portion, wherein the first elongate portion and the second elongate portion form a channel that has the arcuate recess at a proximate end and an opening at a distal end, and two guide pins.

In some implementations, each of the first elongate portion and the second elongate portion includes a first mounting aperture disposed near a proximate end and a second mounting aperture disposed near a distal end. In some implementations, each of the first elongate portion and the second elongate portion includes one or more guide apertures each constructed to receive one of the guide pins.

In some implementations, the one or more guide apertures include a first guide aperture, a second guide aperture, and a third guide aperture. In some implementations, the first guide aperture, the second guide aperture and the third guide aperture correspond to a first difficulty setting, a second difficulty setting, and a third difficulty setting, respectively.

In some implementations, the first difficulty setting is toward the proximate end of the first elongate portion and the second elongate portion, wherein the third difficulty setting is toward the distal end of the first elongate portion and the second elongate portion, and wherein the second difficulty setting is disposed between the first difficulty setting and the third difficulty setting. Some implementations can include one or more mounting elements configured to fit into the first or second mounting apertures of the first elongate portion or the second elongate portion, wherein, when installed, the one or more mounting elements fit through the first or second mounting apertures and extend into the surface the putting training device is being mounted to.

DETAILED DESCRIPTION

Figure 1:
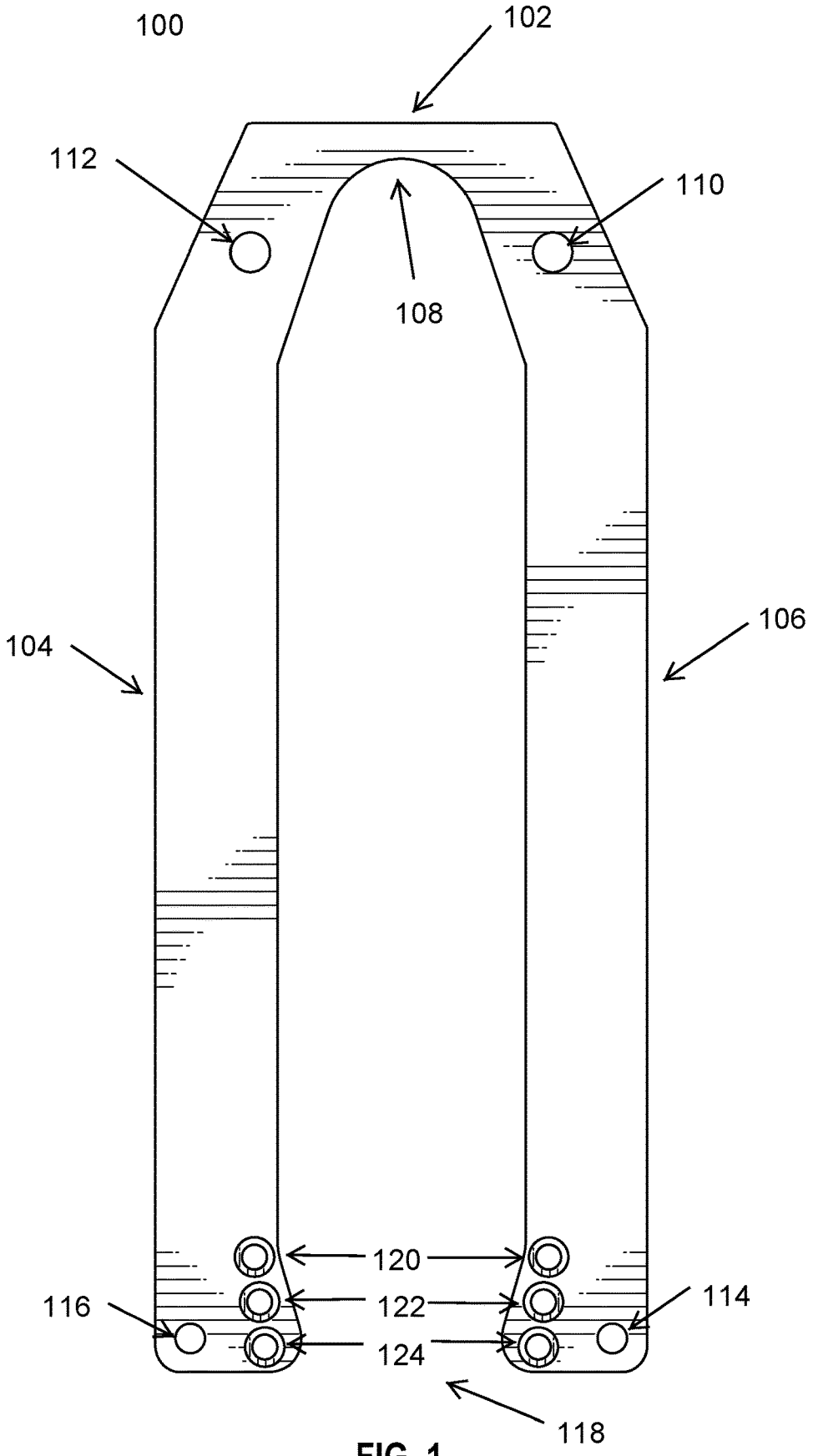
FIG. 1 is a top view of an example golf putting training device in accordance with some implementations.

FIG. 1 is a top view of an example golf putting training device 100, which includes a center portion 102 having an arcuate recess 108. The center portion 102 joins a first elongate portion 104 and a second elongate portion 106. The first elongate portion 104 includes a first mounting aperture 112 and a second mounting aperture 116. The second elongate portion 106 includes a first mounting aperture 110 and a second mounting aperture 114. Each of the first elongate portion 104 and the second elongate portion 106 include a plurality of guide pin apertures in three difficulty settings: easy, using the first paired guide apertures (first guide aperture pair) 120; medium, using the second paired guide apertures (second guide aperture pair) 122; and hard, using the third paired guide apertures (third guide aperture pair) 124. The first elongate portion and the second elongate portion form a channel extending from the arcuate recess 108 at a proximate end to an opening 1 18 at a distal end.

Figure 2:
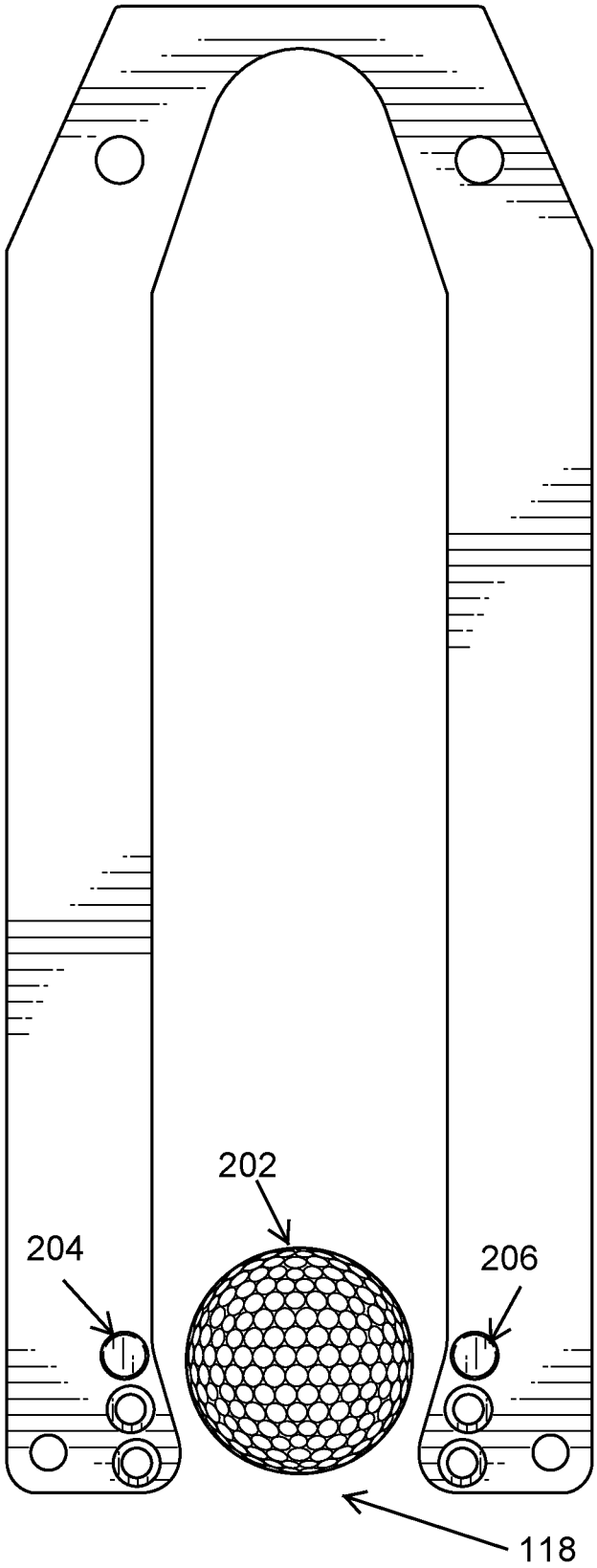
FIG. 2 is a top view of an example golf putting training device showing guide pins in the easy difficulty setting and a golf ball in accordance with some implementations.

FIG. 2 is a top view of an example golf putting training device 100 showing guide pins 204 and 206 in the easy difficulty setting and a golf ball 202 passing through the opening 118 in accordance with some implementations.

Figure 3:
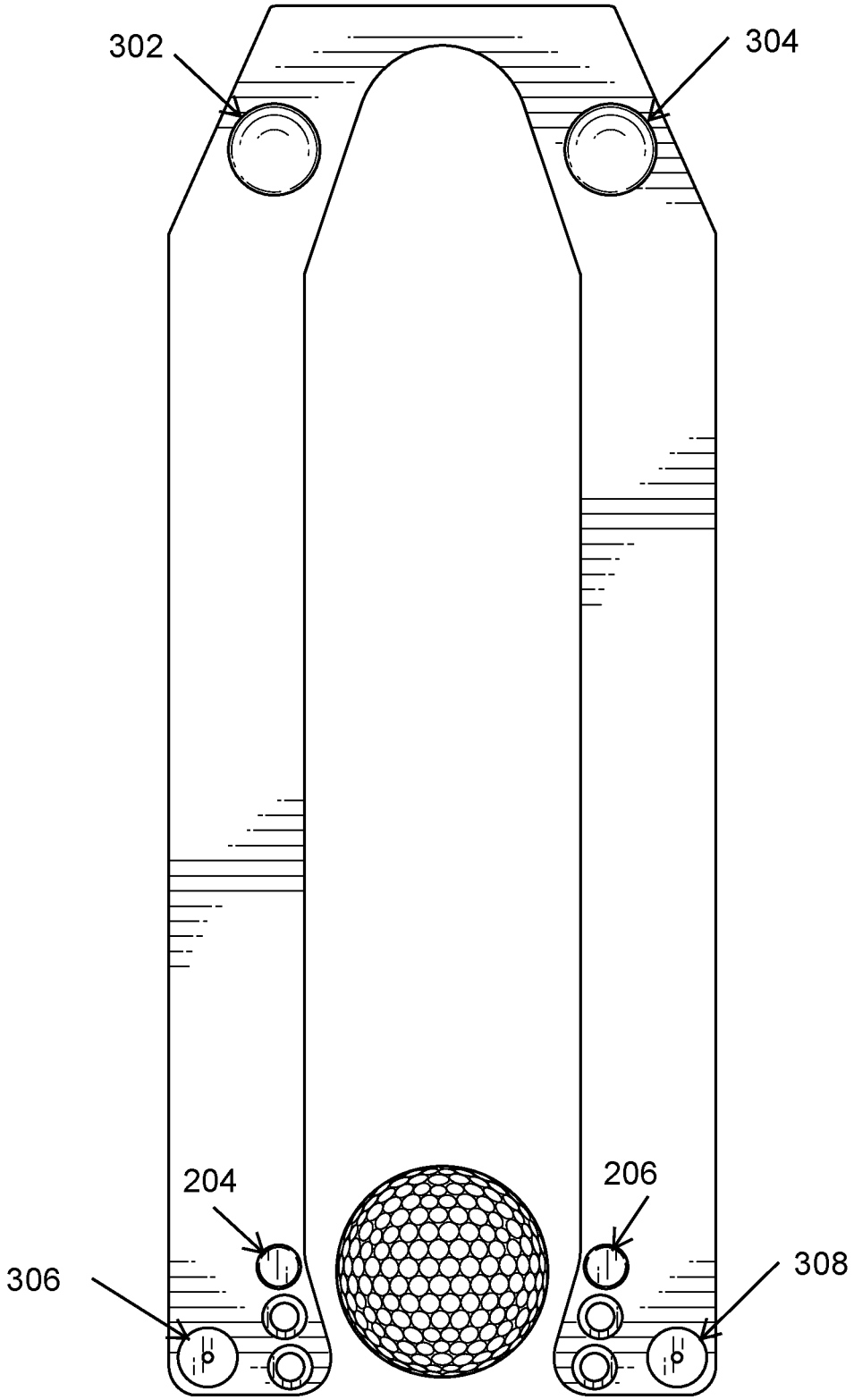
FIG. 3 is a top view of an example golf putting training device showing mounting pins, guide pins in the easy difficulty setting, and a golf ball in accordance with some implementations.

FIG. 3 is a top view of an example golf putting training device showing mounting pins (or elements) 302 and 304 in first mounting apertures, and mounting pins (or elements) 306 and 308 in the second mounting apertures, guide pins 204/206 in the easy difficulty setting, and a golf ball in accordance with some implementations. The mounting pins can include pins specifically designed for inserting into the mounting apertures or can include golf tees, or can include a combination of both (e.g., specifically designed mounting pins 302/304 and golf tees 306/308). The mounting pins are constructed to extend through respective mounting apertures and into a surface below (e.g., into a putting green surface).

Figure 4:
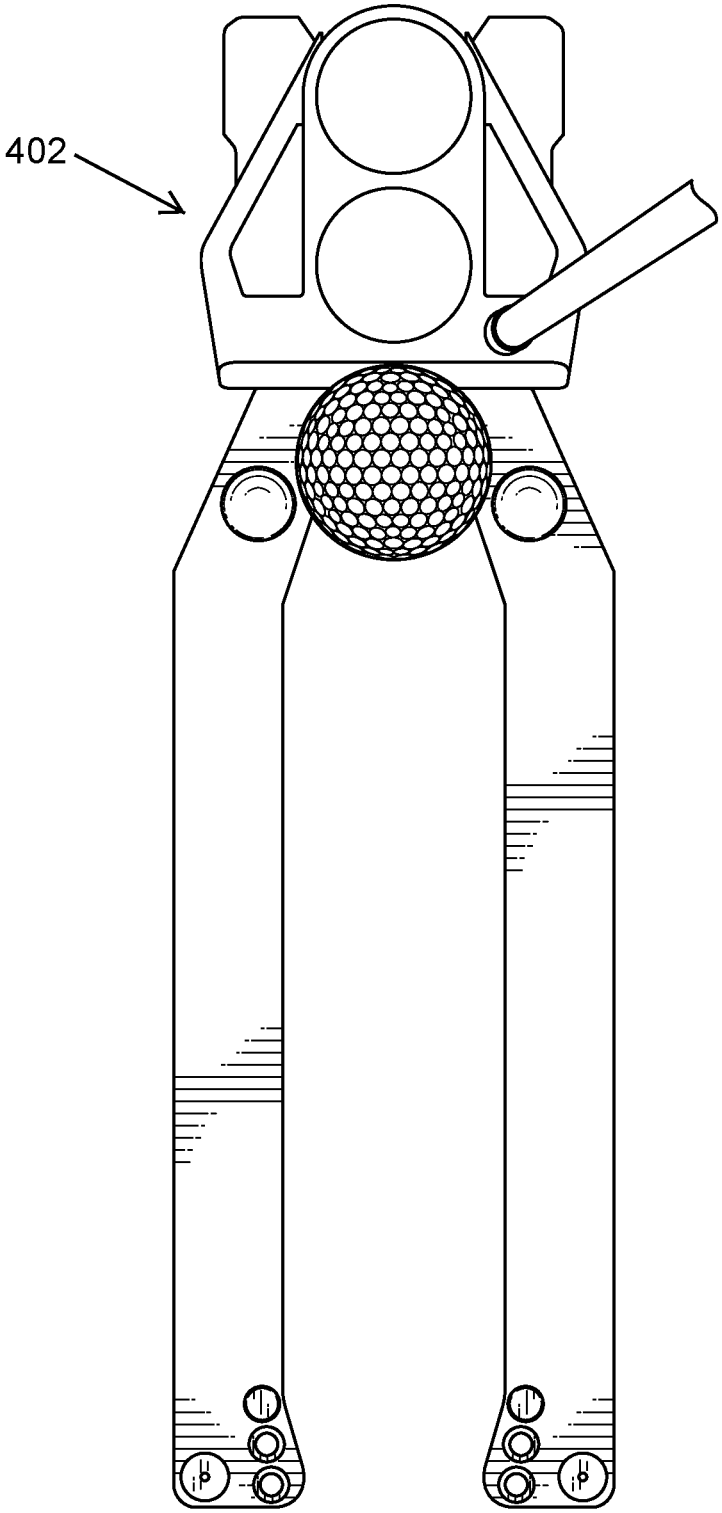
FIG. 4 is a top view of an example golf putting training device showing guide pins in the easy difficulty setting, a golf ball in the arcuate recess, and a putter in accordance with some implementations.

FIG. 4 is a top view of an example golf putting training device showing guide pins in the easy difficulty setting, a golf ball in the arcuate recess, and a putter 402 in accordance with some implementations. In operation, the putter 402 can be swung by a user to putt the golf ball while the training device provides visual feedback and muscle memory training to the user, among other things.

Figure 5:
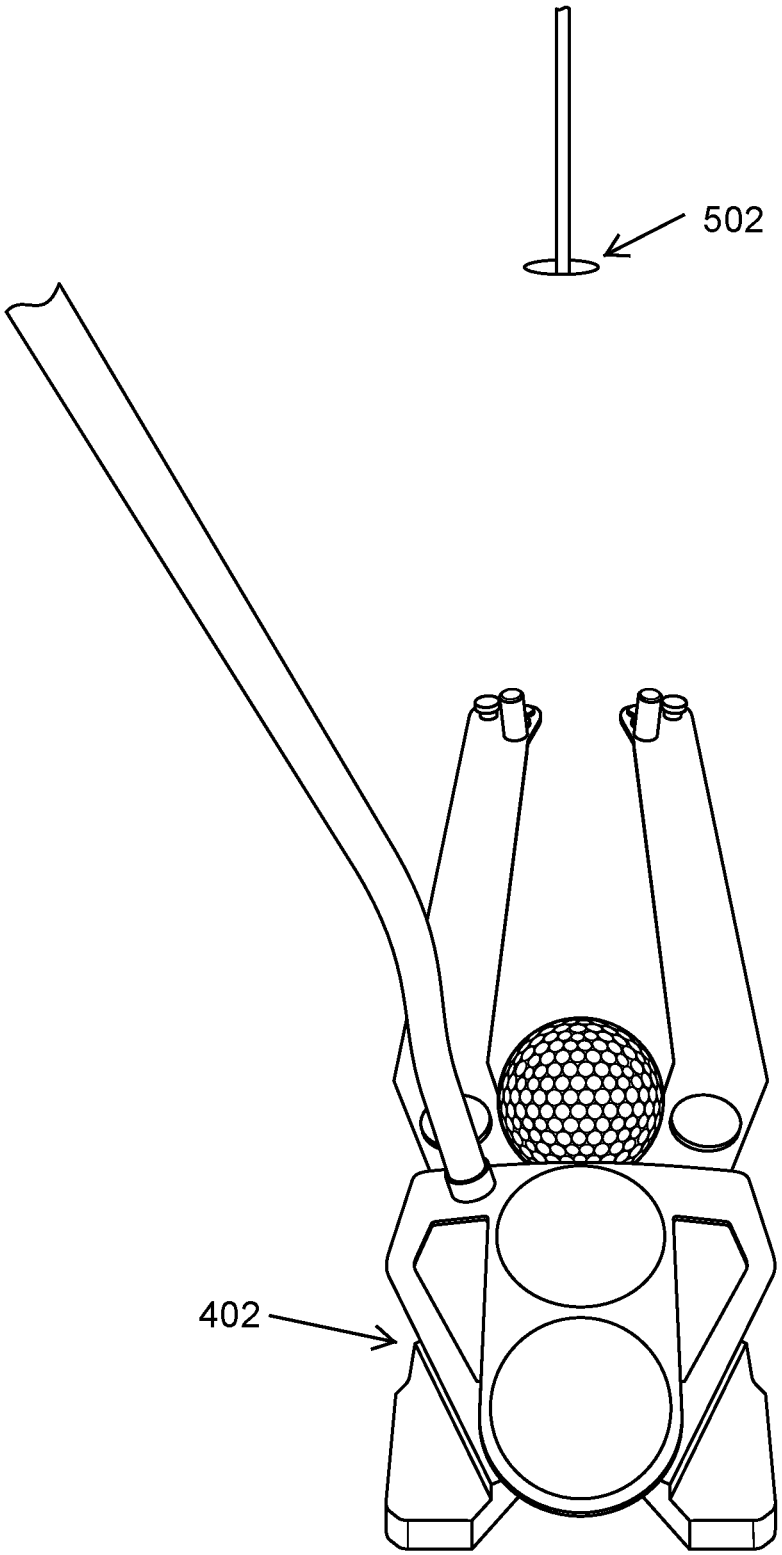
FIG. 5 is a perspective view of an example golf putting training device in use in accordance with some implementations.

FIG. 5 is a perspective view of an example golf putting training device in use where a user is holding a putter 402 to putt the golf ball toward a hole 502 using the putting training device for training visual cues and muscle movement for the golf putting stroke.

Figure 6:
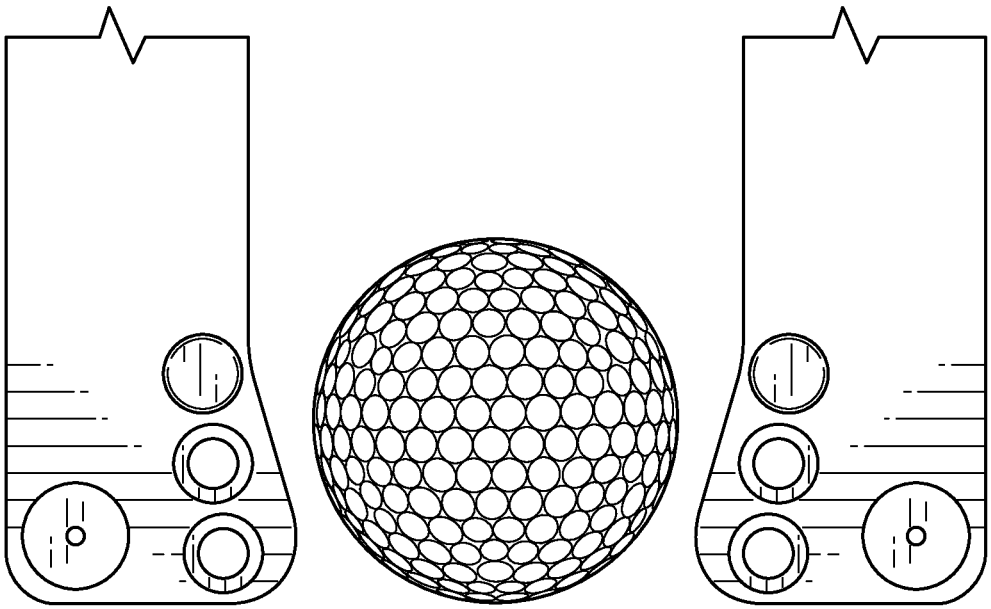
FIG. 6 is a top view of an example golf putting training device with guide pins in the easy difficulty setting in accordance with some implementations.

FIG. 6 is a top view of an example golf putting training device with guide pins 204/206 in the easy difficulty setting (e.g., first paired guide apertures 120 in FIG. 1) in accordance with some implementations.

Figure 7:
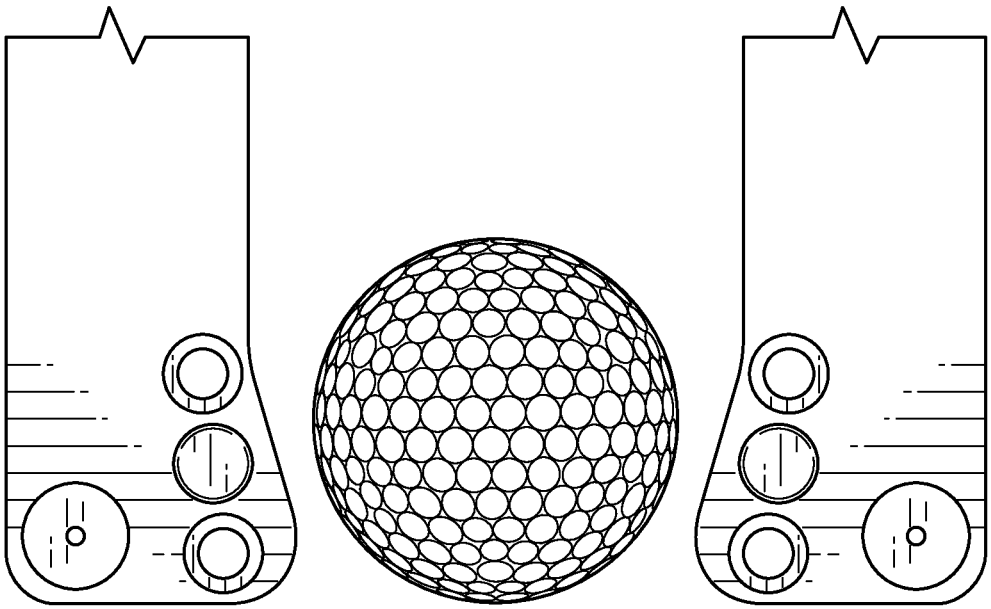
FIG. 7 is a top view of an example golf putting training device with guide pins in the medium difficulty setting in accordance with some implementations.

FIG. 7 is a top view of an example golf putting training device with guide pins 204/206 in the medium difficulty setting (e.g., second paired guide apertures 122 in FIG. 2) in accordance with some implementations.

Figure 8:
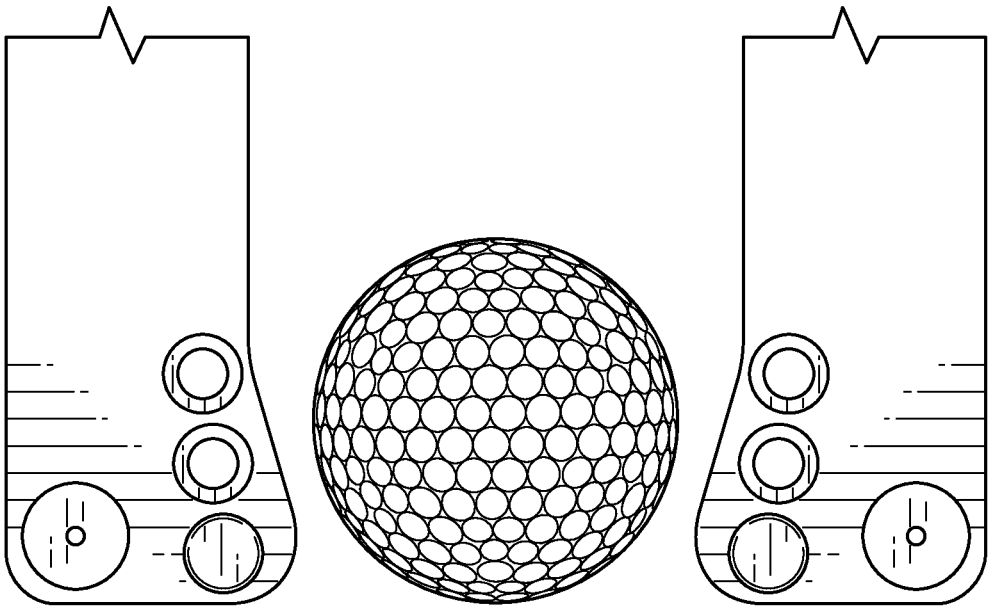
FIG. 8 is a top view of an example golf putting training device with guide pins in the hard difficulty setting in accordance with some implementations.

FIG. 8 is a top view of an example golf putting training device with guide pins 204/206 in the hard difficulty setting (e.g., third paired guide apertures 124 if FIG. 3) in accordance with some implementations.

Figure 9:
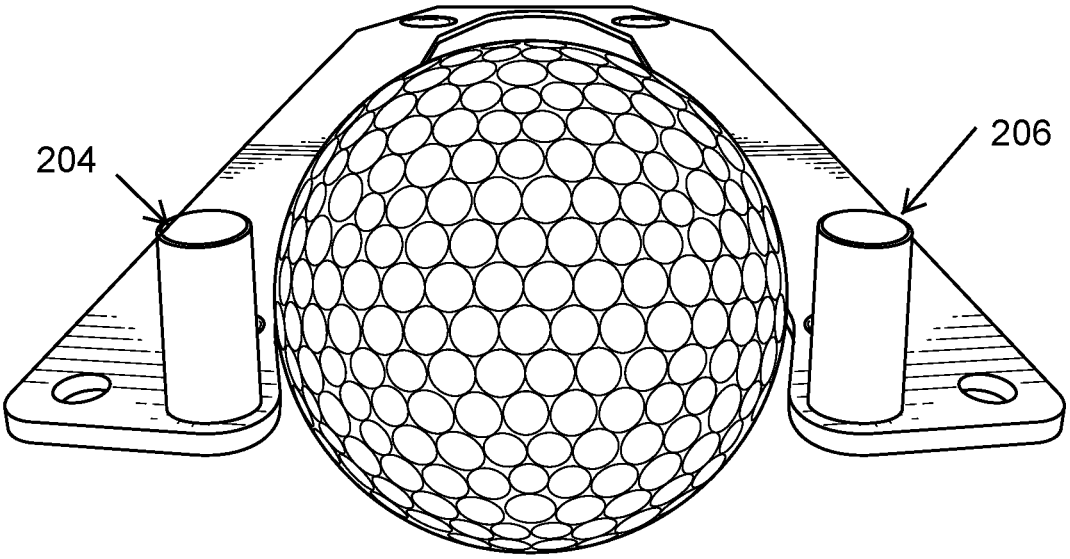
FIG. 9 is a perspective view of an example golf putting training device with guide pins in the hard difficulty setting and a golf ball passing through the opening between the two elongate members and the guide pins in accordance with some implementations.

FIG. 9 is a perspective view of an example golf putting training device with guide pins 204/206 in the hard difficulty setting and a golf ball 202 passing through the opening (e.g., 118) between the two elongate members and the guide pins 204/206 in accordance with some implementations.

Figure 10:
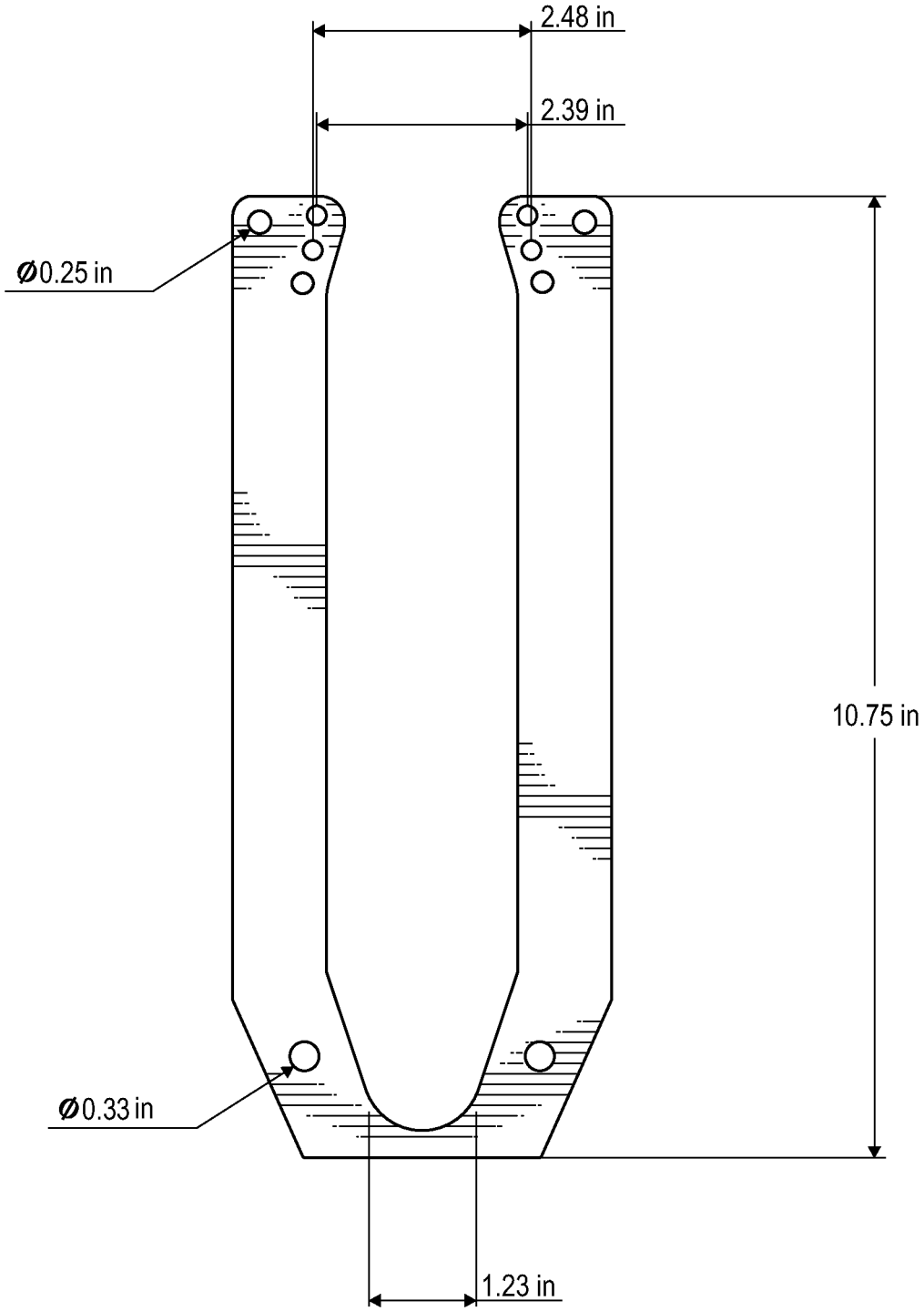
FIG. 10 is a top view of an example golf putting training device showing example dimensions in accordance with some implementations.

FIG. 10 is a top view of an example golf putting training device showing example dimensions in accordance with some implementations. The example dimensions shown in FIG. 5 are intended to be non-limiting example dimensions for purposes of explaining the disclosed subject matter.

The golf putting training device 100 can be formed from metal (e.g., aluminum or steel or other suitable metal), plastic, or other suitable material.

While some example implementations have been described in terms of a general embodiment with several specific example modifications, it is recognized that other modifications and variations of the embodiments described above are within the spirit and scope of the disclosed subject matter. Applicant intends to embrace any and all such modifications, variations and embodiments.

What is claimed is:

1. A putting training device comprising:

a body having a first elongate portion and a second elongate portion that are joined by a center portion having an arcuate recess at a proximate end of the first elongate portion and the second elongate portion, wherein the first elongate portion and the second elongate portion form a channel that has the arcuate recess at a proximate end and an opening at a distal end; and two guide pins;

wherein each of the first elongate portion and the second elongate portion further each includes a mounting aperture disposed near the distal end;

wherein adjacent to the distal end of the opening, the first elongate portion includes a first set of guide apertures and the second elongate portion includes a second set of guide apertures, the first and second sets of guide apertures being separate from the first and second mounting apertures of the first elongate portion and the second elongate portion;

wherein the first set of guide apertures and second set of guide apertures form paired locations across the channel that converge from the proximate end toward the distal end;

wherein the channel is open between the first elongate portion and the second elongate portion, the first elongate portion being separated from the second elongate portion by the channel except where joined by the center portion at the proximate end;

wherein a first paired guide apertures positions the two guide pins at a maximum separation distance;

wherein a second paired guide apertures positions the two guide pins at an intermediate separation distance;

wherein a third paired guide apertures positions the two guide pins at a minimum separation distance;

wherein the first paired guide apertures, second paired guide apertures, and third paired guide apertures are positioned toward the distal end of the first elongate portion and the second elongate portion;

wherein a separation distance between the two guide pins when installed in each paired location defines a putting difficulty level based on a width of a ball gate through which a golf ball must pass after being struck from the arcuate recess.

2. The putting training device of claim 1, wherein the first paired guide apertures toward the proximate end of the first elongate portion and the second elongate portion, wherein the third paired guide apertures are toward the distal end of the first elongate portion and the second elongate portion, and wherein the second paired guide apertures are disposed between the first paired guide apertures and third paired guide apertures.

3. The putting training device of claim 1, further comprising one or more mounting elements configured to fit into the first paired guide apertures or the second paired guide apertures of the first elongate portion or the second elongate portion, wherein, when installed, the one or more mounting elements fit through the first paired guide apertures or the second paired guide apertures and extend into a surface the putting training device is being mounted to.

4. The putting training device of claim 3, wherein the one or more mounting elements comprise one or more mounting pins or golf tees.

5. The putting training device of claim 1, wherein the body is formed from metal.

6. The putting training device of claim 1, wherein the body is formed from plastic.

7. The putting training device of claim 1, wherein the putting training device provides visual feedback to a user of the putting training device.

8. The putting training device of claim 1, wherein the putting training device provides muscle memory training to a user of the putting training device.

9. The putting training device of claim 1, wherein placement of the two guide pins in the first paired guide apertures constitutes a first configuration of the putting training device.

10. The putting training device of claim 1, wherein placement of the two guide pins in the first paired guide apertures constitutes a second configuration of the putting training device.

11. The putting training device of claim 1, wherein placement of the two guide pins in the second paired guide apertures constitutes a third configuration of the putting training device.

12. A putting training device comprising:

a body having a first elongate portion and a second elongate portion that are joined by a center portion having an arcuate recess at a proximate end of the first elongate portion and the second elongate portion, wherein the first elongate portion and the second elongate portion form a channel that has the arcuate recess at a proximate end and an opening at a distal end; and two guide pins;

wherein each of the first elongate portion and the second elongate portion further includes a first mounting aperture disposed near the proximate end and a second mounting aperture disposed near the distal end;

wherein the channel is open between the first elongate portion and the second elongate portion, the first elongate portion being separated from the second elongate portion by the channel except where joined by the center portion at the proximate end;

wherein adjacent to the distal end of the opening, the first elongate portion and the second elongate portion each include multiple guide aperture pairs positioned at progressively narrowing spacings, the multiple guide aperture pairs being separate from the first and second mounting apertures of the first elongate portion and the second elongate portion;

wherein a first guide aperture pair defines a first gap width between installed guide pins;

wherein a second guide aperture pair defines a second gap width between installed guide pins that is narrower than the first gap width;

wherein a third guide aperture pair defines a third gap width between installed guide pins that is narrower than the second gap width;

wherein the first guide aperture pair, the second guide aperture pair, and the third guide aperture pair are positioned toward the distal end of the first elongate portion and the second elongate portion;

wherein the first gap width, second gap width, and third gap width define easy, medium, and hard difficulty settings respectively based on a width of a ball gate through which a golf ball must pass after being struck from the arcuate recess.

13. A putting training device comprising:

a body having a first elongate portion and a second elongate portion that are joined by a center portion having an arcuate recess at a proximate end of the first elongate portion and the second elongate portion, wherein the first elongate portion and the second elongate portion form a channel that has the arcuate recess at a proximate end and an opening at a distal end; and two guide pins;

wherein each of the first elongate portion and the second elongate portion each further includes a mounting aperture disposed near the distal end;

wherein the channel is open between the first elongate portion and the second elongate portion, the first elongate portion being separated from the second elongate portion by the channel except where joined by the center portion at the proximate end;

wherein adjacent to the distal end of the opening the first elongate portion and the second elongate portion each include a first guide aperture pair, a second guide aperture pair, and a third guide aperture pair, the first, second, and third guide aperture pairs being separate from the first and second mounting apertures of the first elongate portion and the second elongate portion;

wherein the first guide aperture pair, the second guide aperture pair, and the third guide aperture pair are positioned toward the distal end of the first elongate portion and the second elongate portion;

wherein when the two guide pins are installed in the first guide aperture pair, the two guide pins are separated by a first distance;

wherein when the two guide pins are installed in the second guide aperture pair, the two guide pins are separated by a second distance that is less than the first distance;

wherein when the two guide pins are installed in the third guide aperture pair, the two guide pins are separated by a third distance that is less than the second distance;

wherein the first distance, the second distance, and the third distance each define a width of a ball gate through which a golf ball must pass after being struck from the arcuate recess.

* * * * *